US011691838B2

(12) United States Patent
Giurlani et al.

(10) Patent No.: US 11,691,838 B2
(45) Date of Patent: Jul. 4, 2023

(54) REWINDING MACHINE FOR PRODUCING PAPER LOGS

(71) Applicant: FUTURA S.P.A., Capannori (IT)

(72) Inventors: Giovacchino Giurlani, Capannori (IT); Gabriele Betti, Capannori (IT); Manolo Tamagnini, Porcari (IT); Simone Parenti, Lucca (IT)

(73) Assignee: FUTURA S.P.A., Capannori (IT)

( * ) Notice: Subject to any disclaimer, the term of this patent is extended or adjusted under 35 U.S.C. 154(b) by 343 days.

(21) Appl. No.: 17/255,020

(22) PCT Filed: May 30, 2019

(86) PCT No.: PCT/IT2019/050122

§ 371 (c)(1),
(2) Date: Dec. 22, 2020

(87) PCT Pub. No.: WO2020/003329

PCT Pub. Date: Jan. 2, 2020

(65) Prior Publication Data

US 2021/0269269 A1 Sep. 2, 2021

(30) Foreign Application Priority Data

Jun. 25, 2018 (IT) ..... 102018000006607

(51) Int. Cl.
*B65H 18/16* (2006.01)
*B65H 23/00* (2006.01)
(Continued)

(52) U.S. Cl.
CPC ..... *B65H 23/005* (2013.01); *B65H 18/145* (2013.01); *B65H 18/16* (2013.01);
(Continued)

(58) Field of Classification Search
CPC .. B65H 18/16; B65H 18/145; B65H 19/2269; B65H 23/005; B65H 2511/13;
(Continued)

(56) References Cited

U.S. PATENT DOCUMENTS 5,267,703 A * 12/1993 Biagiotti ..... B65H 18/26 242/541.7
5,853,140 A * 12/1998 Biagiotti ..... B65H 19/2269 242/534
(Continued)

FOREIGN PATENT DOCUMENTS

EP 1 700 805 B1 9/2010
KR 101703890 B1 2/2017
(Continued)

OTHER PUBLICATIONS

International Search Report and Written Opinion dated Aug. 22, 2019 in corresponding International Application No. PCT/IT2019/050122; 10 pages.

*Primary Examiner* — Sang K Kim
(74) *Attorney, Agent, or Firm* — Maier & Maier, PLLC

(57) ABSTRACT

Rewinder for making paper logs of paper material including a detection system with optical means adapted to detect, in a succession of predetermined detection times, a succession of diameters assumed in such times by a log being formed in a winding station and a programmable electronic unit which compares the diameters measured by the optical means with a succession of corresponding preset diameters and to calculate a sequence of differences. The processing unit receives a signal relating to the value of the actual diameter of the completed log and determines a parameter related to the trend over time of the differences. Elements for adjusting the thickness of the paper web automatically adjust said thickness if the parameter is between predetermined values.

10 Claims, 7 Drawing Sheets

(51) Int. Cl.
*B65H 18/14* (2006.01)
*B65H 19/22* (2006.01)

(52) U.S. Cl.
CPC . *B65H 19/2269* (2013.01); *B65H 2301/5123* (2013.01); *B65H 2511/13* (2013.01); *B65H 2511/14* (2013.01); *B65H 2553/40* (2013.01); *B65H 2557/20* (2013.01)

(58) Field of Classification Search
CPC ..... B65H 2511/14; B65H 2301/5123; B65H 2553/40; B65H 2557/20
See application file for complete search history.

(56) References Cited

U.S. PATENT DOCUMENTS

| | | | | |
|---|---|---|---|---|
| 2003/0189123 | A1* | 10/2003 | Biagiotti | B65H 19/267 242/542.1 |
| 2009/0173819 | A1* | 7/2009 | Maddaleni | B65H 19/2269 242/527.3 |
| 2009/0272835 | A1* | 11/2009 | Benvenuti | B65H 19/2269 242/532.2 |
| 2011/0017860 | A1 | 1/2011 | Vaughn | |
| 2013/0020427 | A1* | 1/2013 | Gelli | B65H 19/2269 242/521 |
| 2017/0280946 | A1 | 10/2017 | Weisang et al. | |

FOREIGN PATENT DOCUMENTS

| | | | |
|---|---|---|---|
| WO | 2012/085953 | A1 | 6/2012 |
| WO | 2016/108843 | A1 | 7/2016 |

* cited by examiner

REWINDING MACHINE FOR PRODUCING PAPER LOGS

FIELD

The present invention relates to a rewinding machine for producing paper logs.

BACKGROUND

It is known that the production of paper logs, from which for example rolls of toilet paper or rolls of kitchen paper are obtained, involves feeding a paper web, formed by one or more superimposed paper plies, on a predetermined path along which various operations are performed before proceeding to the formation of the logs, including a transverse pre-incision of the web to form pre-cut lines which divide it into separable sheets. The formation of logs normally involves the use of cardboard tubes, commonly called "cores" on the surface of which a predetermined amount of glue is distributed to allow the bonding of the paper web on the cores progressively introduced in the machine that produces the logs. commonly called "rewinder", in which winding rollers are arranged which determine the winding of the web on the cores. The glue is distributed on the cores when they pass along a corresponding path comprising a terminal section commonly called "cradle" due to its concave conformation. Furthermore, the formation of the logs implies the use of winding rollers that provoke the rotation of each core around its longitudinal axis thus determining the winding of the web on the same core. The process ends when a predetermined number of sheets is wound on the core, with the gluing of a flap of the last sheet on the underlying one of the roll thus formed (so-called "flap gluing" operation). Upon reaching the predetermined number of sheets wound on the core, the last sheet of the log being completed is separated from the first sheet of the subsequent log, for example by means of a jet of compressed air directed towards a corresponding pre-cutting line. At this point, the log is unloaded from the rewinder. EP1700805 discloses a rewinding machine which operates according to the above-described operating scheme. The logs thus produced are then conveyed to a buffer magazine which supplies one or more cutting-off machines by means of which the transversal cutting of the logs is carried out to obtain the rolls in the desired length.

SUMMARY

The present invention relates specifically to checking the diameter of the logs inside the rewinders and it aims at providing a control system which provides for the automatic adjustment of the thickness of the paper reaching the winding rollers to compensate possible errors due, for example, to the surface wear of the winding rollers and/or to the presence of debris on the surface of the winding rollers and/or to the surface characteristics of the paper. In other words, the present invention allows to automatically adjust, on the basis of the comparison of the measured data of the actual diameter of the log with a corresponding predetermined value, the thickness of the paper web being wound to form the log.

This result has been achieved, in accordance with the present invention, by providing a rewinder having the characteristics indicated in claim 1. Other features of the present invention are the subject of the dependent claims.

Among the advantages offered by the present invention, for example, the following are mentioned: the control of the rewinder is constant over time and does not depend on the experience of operators driving the machines; it is possible to use commercially available optical devices; the cost of the control system is very low in relation to the advantages offered by the invention.

BRIEF DESCRIPTION OF THE DRAWINGS

These and further advantages and features of the present invention will be more and better understood by every person skilled in the art thanks to the following description and the attached drawings, provided by way of example but not to be considered in a limiting sense, in which.

DETAILED DESCRIPTION OF THE EMBODIMENTS

Figure 1:
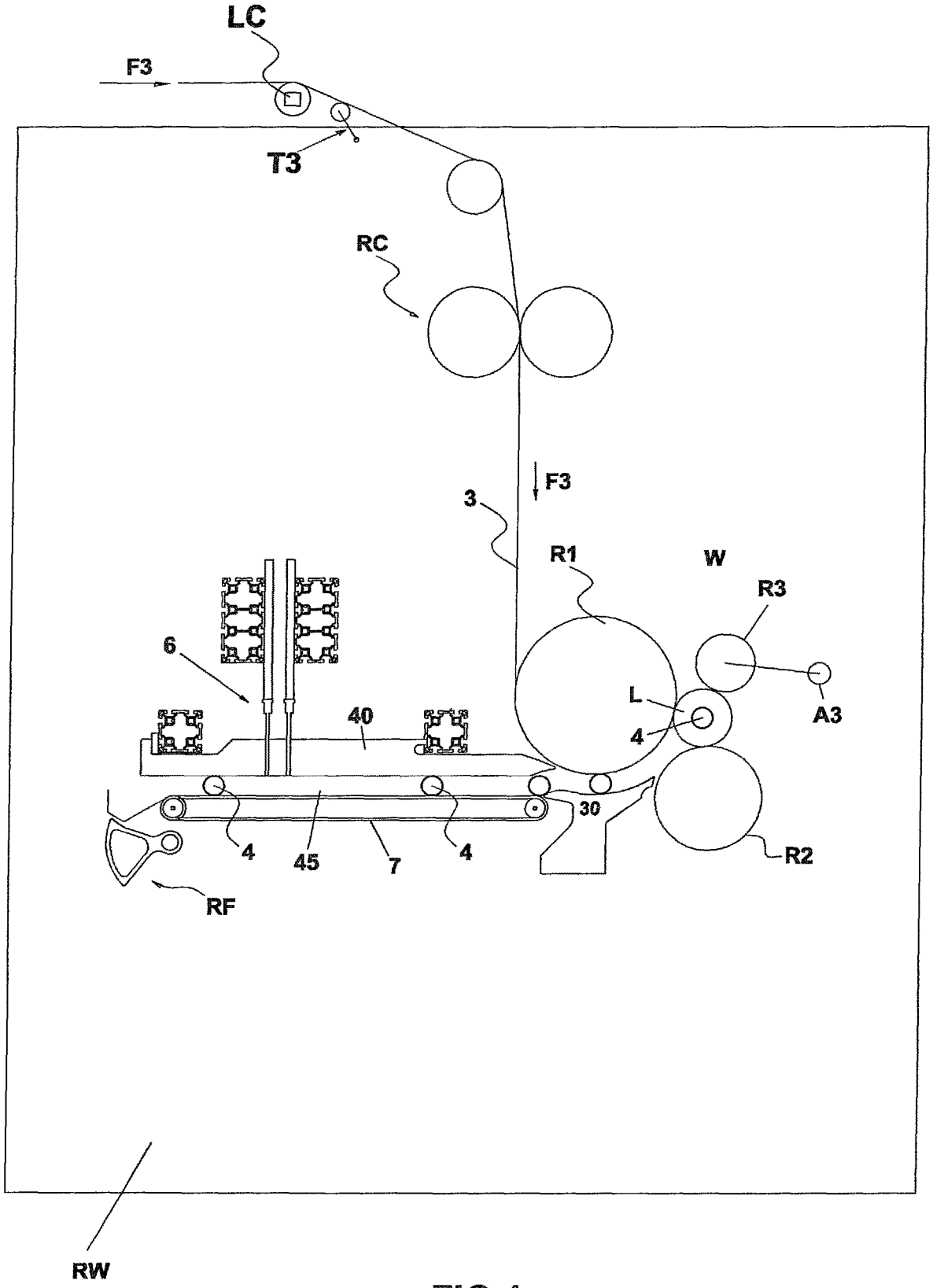
FIG. 1 shows a schematic side view of a rewinder for the production of logs of paper material with a log (L) in the formation phase and with a part of a paper converting plant arranged upstream of the rewinder that is also schematically represented.
Figure 2:
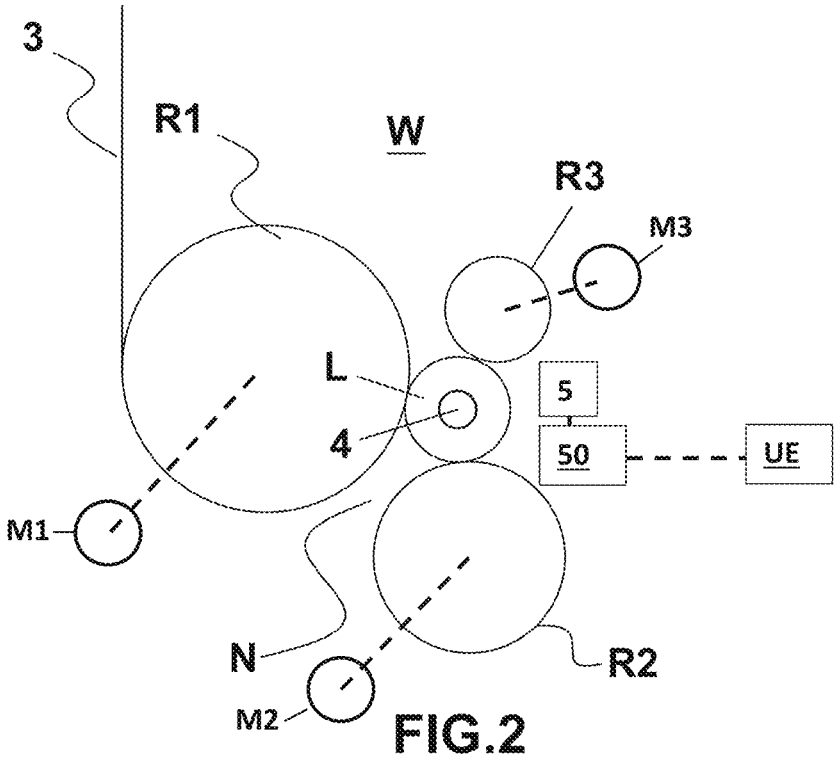
FIG. 2 represents a detail of FIG. 1.

A control system according to the present invention is applicable, for example, for controlling the operation of a rewinder (RW) of the type shown in FIG. 1 and FIG. 2. The rewinder comprises a station (W) for winding the paper with a first winding roller (R1) and a second winding roller (R2) apt to delimit, with the respective external surfaces, a nip (N) through which is fed a paper web (3) formed by one or more paper plies and is intended to be wound around a tubular core (4) to form a log (L). The web (3) is provided with a series of transverse incisions which divide the web itself into consecutive individual sheets and facilitate the separation of the individual sheets. The transverse incisions are made in a manner known per se by a pair of pre-cutting rollers (RC) arranged along the path followed by the paper web (3) upstream of the winding station (W). Each log (4) consists of a predetermined number of sheets wound around the core (4). During the formation of the log, the diameter of the latter increases up to a maximum value which corresponds to a predetermined length of the web (3), or to a predetermined number of sheets. In the winding station (W) a third winding roller (R3) is provided which, with respect to the direction (F3) followed by the web (3), is arranged downstream of the first and the second winding rollers (R1, R2). Furthermore, the second winding roller (R2) is placed at a lower level than the first winding roller (R1). According to the example shown in the attached drawings, the axes of rotation of the first roller (R1), of the second roller (R2) and of the third roller (R3) are horizontal and parallel to each other, i.e. oriented transversely with respect to the direction followed by the web (3). The third roller (R3) is connected to an actuator (A3) which allows it to be moved from and to the second roller (R2), that is, it allows the third roller to be moved from and towards the aforementioned nip (N). Each of said rollers (R1, R2, R3) rotates about its longitudinal axis being connected to a respective motor (M1, M2, M3). The cores (4) are introduced sequentially into the nip (N) by means of a conveyor that, according to the example shown in FIG. 1, comprises motorized belts (7) arranged underneath fixed plates (40) which in cooperation with the belts (7), force the cores (4) to move by rolling along a straight path (45). The latter develops between a core feeding section, where an introducer (RF) is arranged, and a cradle (30) arranged under the first winding roller (R1). In correspondence with said path (45), nozzles (6) are arranged to supply glue that is applied to each core (4) to allow the first sheet of each new log to adhere to the core itself and to glue the last log sheet on the underlying sheets. The operation of a rewinder of the type described above is known per se.

Upstream of the rewinder (RW), in particular upstream of the pre-cutting rollers (RC) that provide for the transverse incision of the web (3), other devices can be provided for checking and/or treating the paper web (3).

These devices can comprise a load cell (LC) designed to check the tension of the web advancing towards the winding station (W) and a tensioning device (T3) through which it is possible to determine the value of the web (3) tension.

Figure 12:
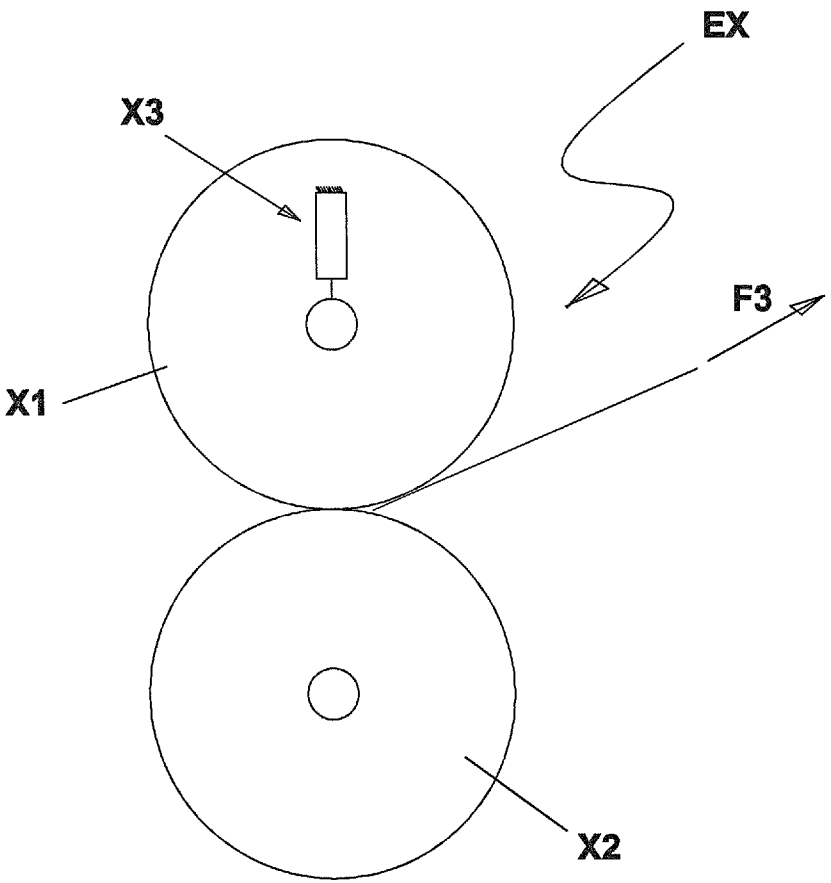
FIG. 12 schematically shows a possible paper treatment device arranged upstream of the rewinder, in particular, FIG. 12 relates to a calendaring device (EX).
Figure 11:
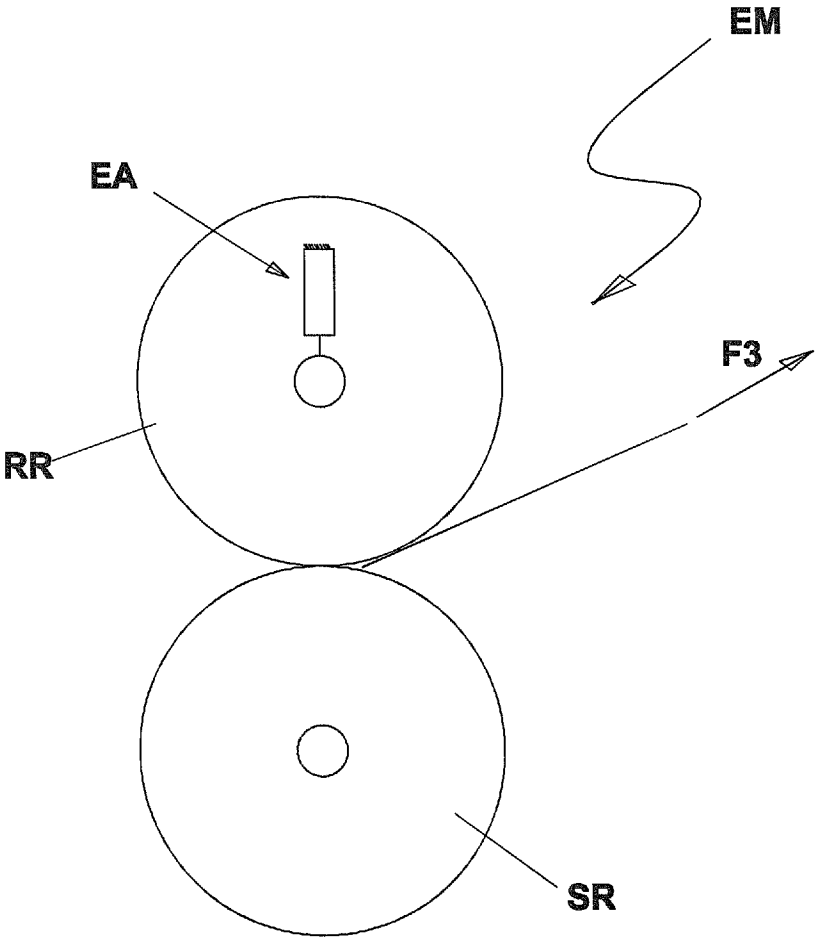
FIG. 11 schematically shows a possible paper treatment devices arranged upstream of the rewinder, in particular FIG. 11 relates to an embossing device (EM)

Upstream of the load cell (LC), further devices can be provided for treating the paper web. FIGS. 11 and 12 show two possible embodiments of such means.

FIG. 11 schematically shows an embossing device (EM) composed of a steel roller (SR) and a rubber roller (RR) arranged opposite to each other and adapted to carry out the embossing of the paper web which is directed along the path indicated by the arrow (F3) towards (RW). The embossing pressure exerted on the paper web, is regulated by an actuator (EA) which is connected to a processing unit (UE) as further disclosed in the following below and is controlled by the same processing unit.

If the paper web is not subjected to an embossing process, the paper converting plant can comprise a calendering device (EX), like the one schematically shown in FIG. 12 upstream of the rewinder (RW). The calendering device (EX) is composed of two rollers (X1, X2) arranged opposite to each other and able to carry out the calendering of the paper web that goes along the path indicated by the arrow (F3) towards the rewinder (RW). The pressure exerted by said rollers on the paper web is regulated by an actuator (X3) which is connected to the processing unit (UE) and is controlled by the latter.

It is understood that, for the purposes of the present invention, the system for feeding the cores (4) to the winding station (W), as well as the methods and means for dispensing the glue on the cores (4) as well as the load cell (LC), the tensioning device (T3), the embossing unit (EM) and and the calendering unit (EX) can be made in any other way.

The motors (M1, M2, M3) and the actuator (A3) are controlled by the programmable electronic unit (UE) as further described in the following.

According to the present invention, for example, an optical vision system comprising a camera (5) adapted to take images of one end of the log being formed can be used. The image of each log (L) detected by the camera (5) therefore corresponds to a two-dimensional shape whose edge is detected by discontinuity analysis of light intensity performed using so-called "edge-detection" algorithms. These algorithms are based on the principle according to which the edge of an image can be considered as the border between two dissimilar regions and essentially the contour of an object corresponds to a sharp change in the levels of luminous intensity. Experimental tests were conducted by the applicant using an OMRON FHSM 02 camera with OMRON FH L 550 controller. The camera (5) is connected to the programmable electronic unit (UE) which receives the signals produced by the same camera. The latter provides the programmable unit (UE) with the diameter of the log. In this example, said controller (50) is programmed to calculate the equation of a circumference passing through three points (H) of the edge (EL) detected as previously mentioned and to calculate its diameter. In practice, the identification of the three points (H) arranged on the outer circumference of the log being formed determines the achievement of the corresponding diameter.

The camera (5) is operated by the unit (UE) for a predetermined number of times in a predetermined time interval to obtain corresponding values for the diameter of the log being formed. In other words, the photo camera (5) performs a plurality of detections during the formation of the log (L), with a distribution of these detections over time which may not be constant. In fact, it has been verified that an optimal detection for the entire formation of the log can be determined by carrying out a considerable part of detections in the initial part of the formation of the log; for example, the inventors believe that it is more effective to perform about 70% of the detections in the initial part of the winding, corresponding to substantially the 30% of the entire winding and the remaining part of detections (about 30%) in the remaining 70% part of the winding.

Figure 4:
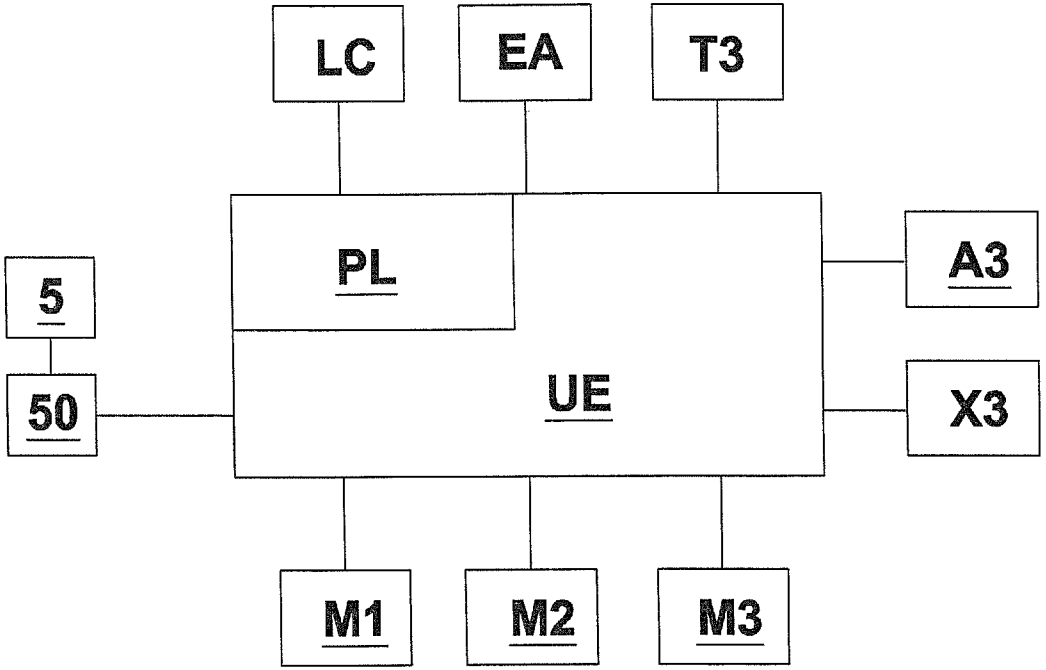
FIG. 4 is a simplified block diagram concerning the programmable electronic unit (UE) shown in FIG. 2.

In practice, during the formation of the log (L) the camera (5) performs a series of detections which determine a corresponding series of values of the actual diameter (DE) of the log being formed. The processing unit (UE), which can comprise a PLC control system (marked by the block PL in FIG. 4), compares the values obtained from the detections (DE) with the corresponding preset reference values (DT) that the log should have at the corresponding winding phases. In practice, the system compares the succession of values of the actual measured diameters (DE) with the corresponding sequence of preset reference diameters (DT). The above-mentioned data processing is used for the automatic adjustment of the so-called "return", i.e. to automatically establish how the speed of the lower roller (R2) must be changed with respect to the speed of the upper roller (R1), both motors (M1, M2) of the rollers (R1, R2) being controlled by said processing unit (UE).

Figure 6:
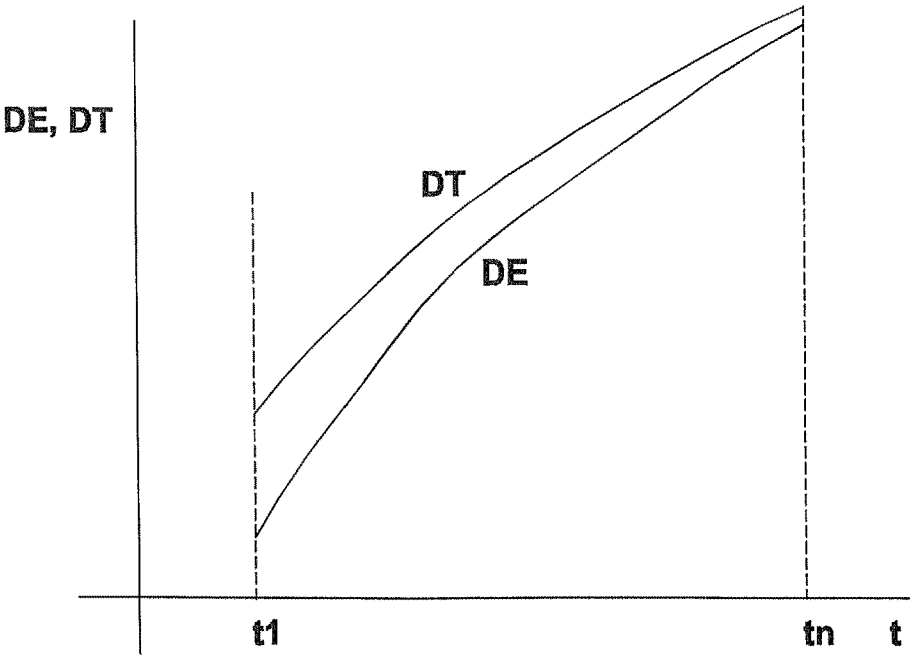
FIG. 6 is a diagram illustrating the measuring of the log diameter in accordance with the present invention.

In practice, during the growth phase of the log (L), i.e. during its formation in correspondence of the rollers of the winding station (W), the camera (5) carries out a succession of shots at predetermined times. For each photo image taken by the camera (i.e. for each detection of the three points H indicated in the drawings), the value of the effective diameter (DE) is determined, and this value is compared, for each detection, with a corresponding preset reference value or theoretical diameter (DT) which is stored in the processing unit (UE) of the respective control unit (PL). The processing unit (UE), based on the comparison between the actual diameters (DE) and the corresponding theoretical diameters (DT), determines, for each detection and each comparison, the error related to the diameter of the log over time, i.e. during the winding of the log. FIG. 6 shows two curves which qualitatively show a possible trend over time of the actual measured diameter value (DE) and the preset theoretical value (DT). In this example, it is assumed that the error progressively decreases during the winding.

Figure 3A:
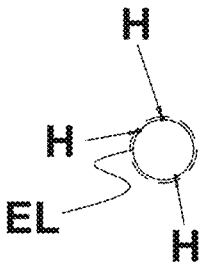
FIG. 3A schematically shows a log being formed seen from a side thereof, in different winding configurations.
Figure 3B:
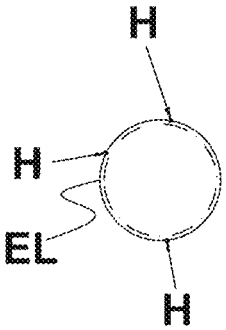
FIG. 3B schematically shows a log being formed seen from a side thereof, in different winding configurations.
Figure 3C:
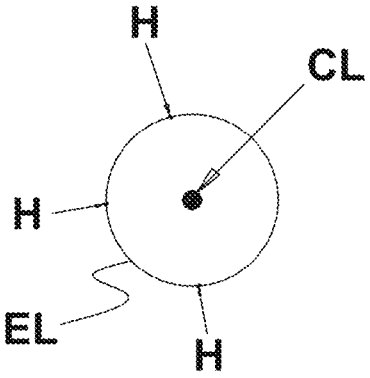
FIG. 3C schematically shows a log being formed seen from a side thereof, in different winding configurations.

The diagrams in FIGS. 3A-C represent three possible situations of error detection in three different times. In FIG. 3A the diameter measured based on the position of the points (H) is smaller than the theoretical one (circumference in dotted line); in FIG. 3B the detected diameter is greater than the theoretical one; in FIG. 3C the detected diameter coincides with the theoretical one. In the drawings the reference (CL) indicates the center of the log.

Figure 5:
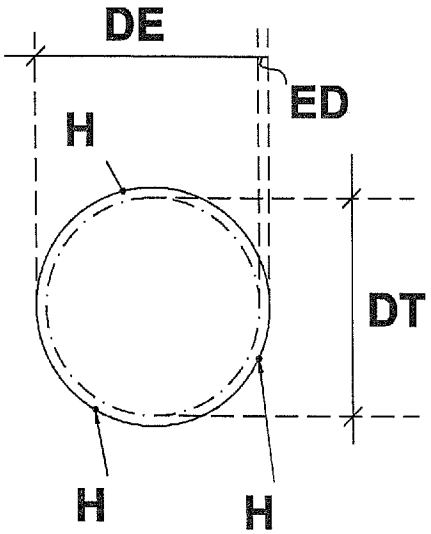
FIG. 5 is a diagram relating to a possible control performed in a rewinder according to the present invention.

In FIG. 5 the reference (ED) represents the difference between the two above mentioned diameters (DT, DE).

Figure 7A:
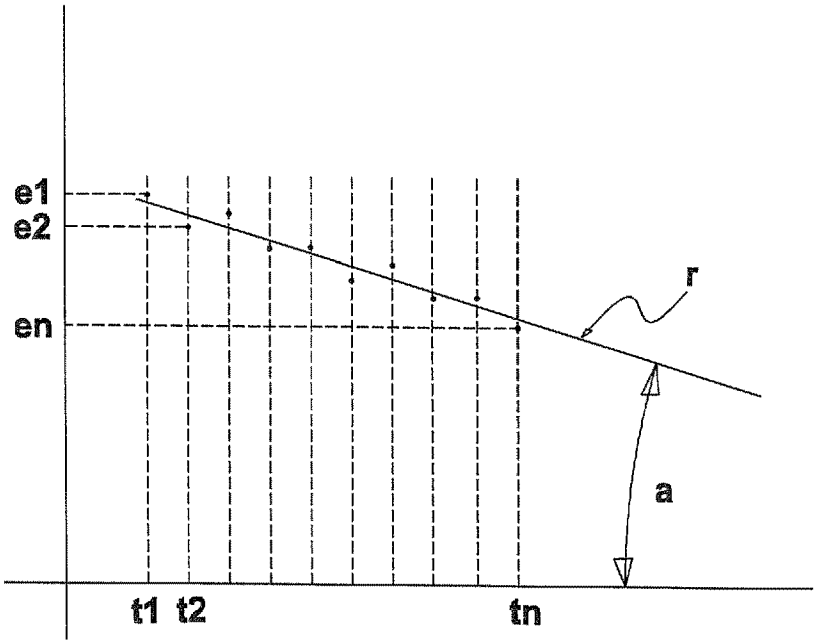
FIG. 7A is a diagram illustrating the measuring of the log diameter in accordance with the present invention.
Figure 7C:
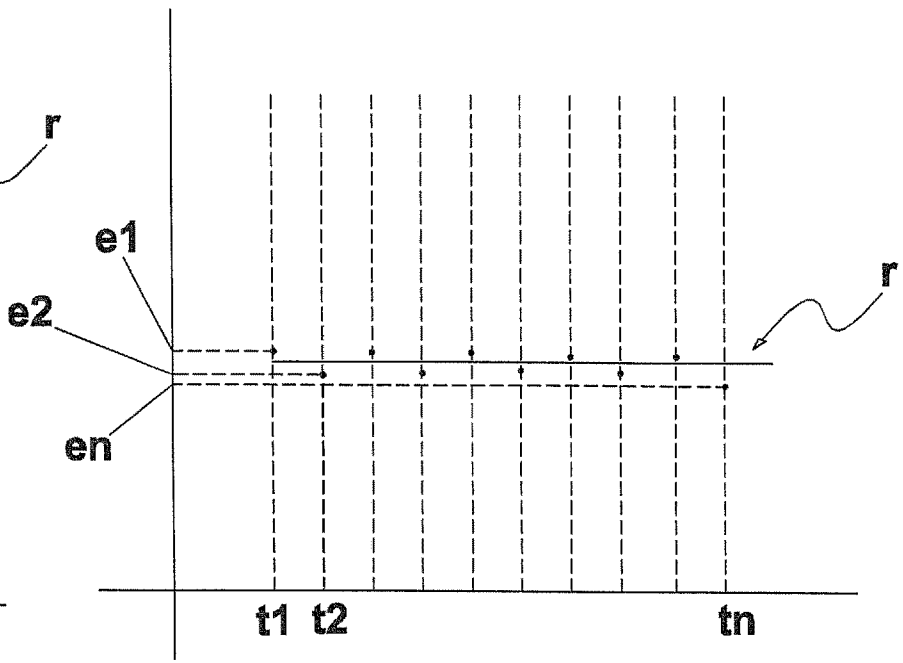
FIG. 7C is a diagram illustrating the measuring of the log diameter in accordance with the present invention.
Figure 7B:
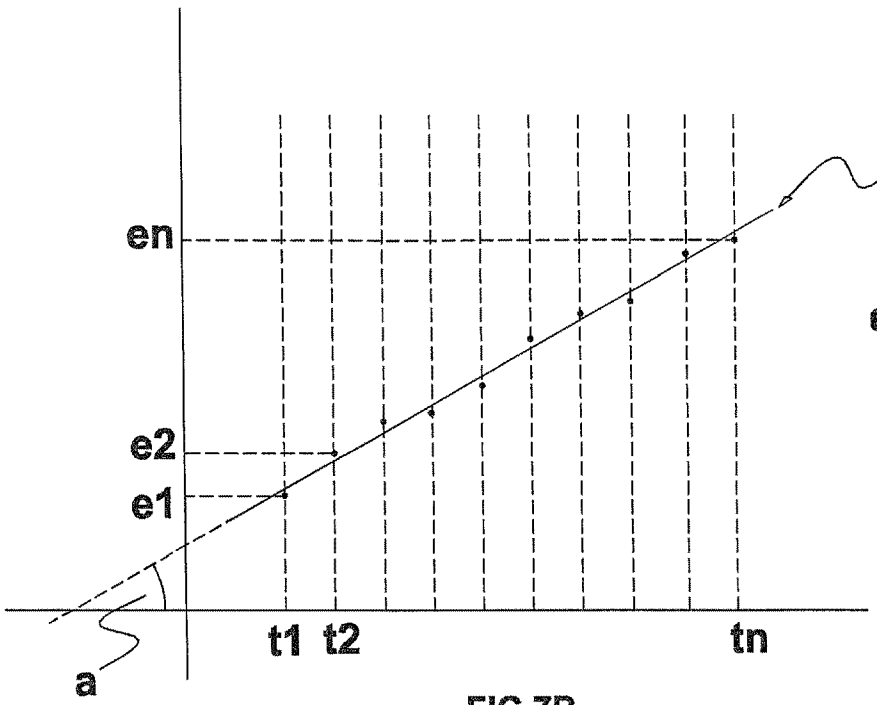
FIG. 7B is a diagram illustrating the measuring of the log diameter in accordance with the present invention.

FIGS. 7A, 7B and 7C represent three possible trends of the errors (e1, e2, . . . , en) of diameter detected in different consecutive times (t1, t2, . . . , tn), where at each time the error is given by the difference between the detected diameter (DE) and the theoretical preset diameter (DT) and the straight line (r) is a line whose equation is determined by the unit (UE) applying, for example, the method of least squares to the set of values (e1, e2, . . . , en). In any case, a linear correlation is established between the aforementioned values (e1, e2, . . . , en) apt to indicate the temporal progression of the errors (e1, e2, . . . , en), the correlation allowing to establish whether the errors decrease, increase or remain constant over time as schematically shown in FIGS. 7A, 7B and 7C.

The times in which the measurements are performed in the graphs of FIGS. 7A, 7B and 7C have been shown equally spaced to simplify the drawings but, as previously disclosed, most of the detections are preferably performed in the initial part of the winding.

The aforementioned trend is represented by the slope (a) of the straight line (r) with respect to the time axis.

In practice, if the errors (e1, e2, . . . , en) tend to decrease, said line has a negative slope (a), as schematically shown in FIG. 7A.

If the errors (e1, e2, . . . , en) tend to increase, said line has a positive slope (a), as schematically shown in FIG. 7B.

Finally, if the errors (e1, e2, . . . , en) have a substantially constant value, said line has a substantially zero slope (a), as schematically shown in FIG. 7C.

Depending on the slope (a) of the line (r), the processing unit (UE) can determine a corresponding correction of the return defined above.

For example, for values of (a) lower than zero (as in FIG. 7A) the processing unit (UE) increases the return, i.e. it determines a decrease in the speed of rotation of the roller (R2) with respect to the roller (R1).

For values of (a) greater than zero (as in FIG. 7B) the processing unit (UE) decreases the return, i.e. it determines an increase in the speed of rotation of the roller (R2) with respect to the roller (R1).

For values of (a) substantially equal to zero (as in FIG. 7C), for example for values between −0.1 and +0.1, the processing unit (UE) does not perform any correction.

The aforementioned value (a) represents, more generally, a parameter related to the trend over time of the values (e1, e2, . . . , en) forming said sequence of differences.

According to the example described above in which (a) is the slope of the line (r), the processing unit (UE) modifies the relative speed of said first and second rollers (R1, R2) when said parameter is external to a predetermined range of values containing the zero value.

The possible correction is performed after the completion of the log winding cycle and therefore will affect the subsequent logs.

The processing unit (UE) can be provided with display means that can display, for example, the values of the actual diameters as detected, the values of the errors with respect to theoretical reference values, the trend of the errors over time, and the possible speed variations of lower roller of the winding station with respect to the upper roller.

The same processing unit can carry out a further automatic adjustment if parameter (a) is between the values aN and aP, i.e. $aN \leq a \leq aP$, where aN and aP are the ends of a range which contains the zero. For example aN=−0.1 and aP=+0.1.

Figure 9:
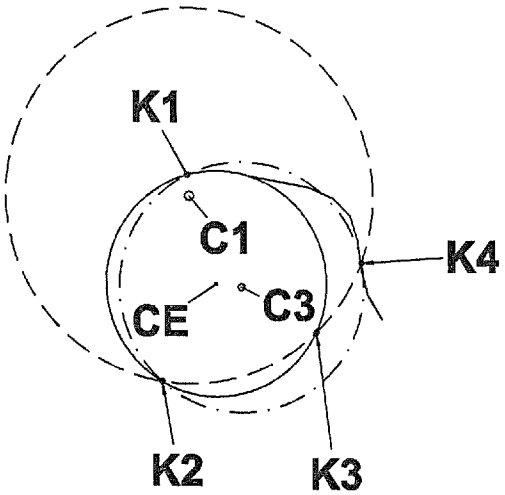
FIG. 9 is a diagram related to checks carried out in a rewinder according to the present invention.
Figure 8:
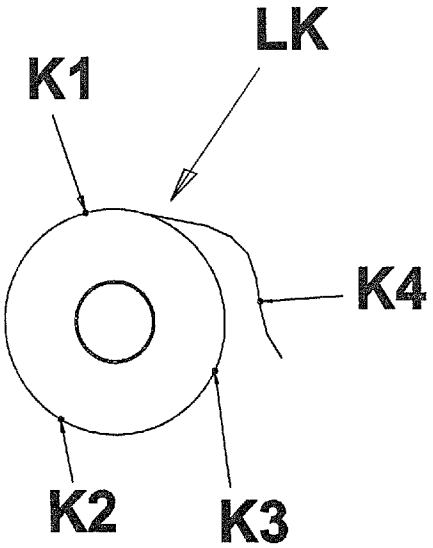
FIG. 8 is a diagram related to checks carried out in a rewinder according to the present invention.

In this case a check is carried out on the actual diameter of the completed log (LK), as schematically shown in FIGS. 8 and 9.

The images produced by the camera (5) can be processed to detect the edge (EK) of the completed log end (LK). The controller (50) associated with the camera (5) is programmed to calculate the equations of the three circumferences passing through three points of a set of four points (K1, K2, K3, K4) of the edge (EK). In accordance with the invention, the controller (50) is programmed to calculate the diameter of each of said circumferences and to assume as the effective diameter (DE) of the log (LK) only that of the circumference having the smaller diameter among all said circumferences.

The diameter value (DEK) thus determined is compared by the unit (UE) with a preset value (DTK).

The difference (EDK) between the value of the diameter (DEK) thus determined and the preset value (DTK), i.e. the value EDK=DEK−DTK, is taken as a completed log diameter error (LK), that is, an error concerning the diameter of the completed log.

In the diagram of FIG. 9 four points are used (K1, K2, K3, K4) which give rise to three circles. The circle drawn with a solid line is the circle with the smallest diameter (center CE), the circle drawn with the dash-and-dot line is the circle with an intermediate diameter (center C3), and the circumference drawn with a dashed line is the circumference having the maximum diameter (center C3). Point "K4" is a point on the final edge of the log that in general could be distanced from the rest of the log. In this phase, the log is completed, i.e. the third roller (R3) no longer exerts any pressure on it. The time in which the diameter (DEK) is measured coincides with the time in which the actuator (A3) moves the third roller (R3) away from the completed log. If the detected error (EDK) is greater than a predetermined value, the processing unit (UE) controls an adjustment of the thickness of the paper web (3) reaching the winding station (W) acting, depending on the positive or negative sign of the error (EDK), on paper thickness adjustment means that, as further described below, can be differently structured.

If (EDK) is positive and greater than the predetermined limit value, i.e. DEK>DTK, then the unit (UE) commands a decrease in the thickness of the paper web (3) reaching the winding station (W). On the contrary, if (EDK) is negative and its absolute value is greater than the predetermined limit value, i.e. DEK<DTK, then the unit (UE) commands an increase in the thickness of the paper web (3) reaching the winding station (W).

For example, if DEK>DTK, the processing unit (UE) initially acts on the tensioning device (T3) increasing the value of the tension to which the paper web is subjected; in this way the paper web (3) will be subjected to a greater tension and, therefore, its thickness log will be decreased. For example, the tension is increased by 100 gr/m.

If, despite the intervention of the tensioning device (T3), DEK is again greater than DTK beyond the limit value, if the paper web comes from an embossing unit (EM), it is possible to change the embossing characteristics.

In particular, it is possible to reduce the pressure that the rubber roller (RR) of the unit (EM) exerts on the steel roller (SR) by controlling the actuators (EA) which are normally provided in any embossing unit (EM) and which allow to adjust the distance between the axes of the rollers (RR, SR) of the embossing unit.

If the paper (3) comes from a calendering unit (EX), in order to decrease the thickness of the paper web, the processing unit (EU) will command an increase in the pressure between the two calendering rollers (X1, X2), acting on the actuator (X3) that is normally provided in any calendering unit used in paper converting plants to adjust the distance between the rollers of the calendering unit.

As said above, if (EDK) is negative and its absolute value is greater than the predetermined limit value, i.e. DEK<DTK, then the unit (UE) commands an increase in the thickness of the paper web (3) reaching the winding station (W).

For example, if DEK<DTK, the processing unit (UE) initially acts on the tensioning device (T3) by decreasing the tension to which the paper is subjected; in this way the paper web (3) will be subjected to a lower tension and, therefore, its thickness will be increased. For example, the tension is reduced by 100 gr/m.

If, despite the intervention on the tensioning device (T3), DEK is again lower than DTK beyond the limit value, if the paper comes from an embossing unit (EM), it is possible to change the embossing characteristics.

In particular, it is possible to increase the pressure that the rubber roller (RR) of the unit (EM) exerts on the steel roller (SR) by means of the actuators (EA) similarly to what has been disclosed above.

If the paper (3) comes from a calendering unit (EX), in order to increase the thickness of the paper web, the processing unit (EU) will command a decrease of the pressure between the two calendering rolls (X1, X2), acting on the actuator (X3).

Figure 10:
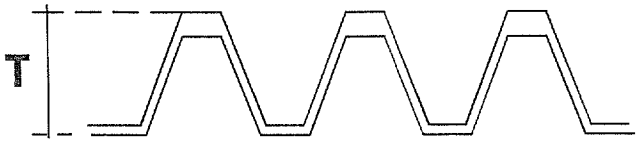
FIG. 10 shows schematically how the thickness (T) of a paper web can vary by effect of the embossing to which it is subjected.

The scheme of FIG. 10 shows the thickness (T) of the paper web (3) formed by two plies subjected to embossing.

By increasing the thickness (T) of the paper (3), all other conditions being equal, the diameter (LK) of the completed log increases. Conversely, if the paper thickness (T) is reduced, the diameter (LK) of the completed log decreases.

In practice, the details of execution can in any case vary in an equivalent manner as regards the individual elements as described and illustrated and their mutual arrangement without departing from the scope of the adopted technical and therefore remaining within the limits of the protection conferred by the present patent according to the appended claims.

The invention claimed is:

1. A rewinder for the production of logs of paper material, comprising: a winding station for winding the paper with a first winding roller and a second winding roller adapted to delimit, with their respective external surfaces, a nip through which a paper web comprising one or more paper plies is fed and is intended to be wound in said station to form a log, and a third winding roller that, in relation to a feeding direction of the web, is positioned downstream of the first and the second winding rollers, wherein the second winding roller is positioned at a lower level than the first winding roller, wherein said first, second and third winding rollers rotate around respective axes of rotation, wherein the axes of rotation of the first winding roller, the second winding roller and the third winding roller are horizontal and parallel to each other and are oriented transversely to said feeding direction, wherein the third winding roller is connected to an actuator which allows it to be moved cyclically from and to said nip so that the position of the winding third roller varies in relation to the other two winding rollers during the production of the logs, and wherein each of said winding rollers rotates around its own axis being connected to a corresponding electric motor, wherein:

the rewinder comprises a detection system with optical means adapted to detect, in a succession of predetermined detection times, a succession of diameters assumed in such times by a log being formed in the winding station, and a programmable electronic unit that is connected to said electric motors and to said optical means;

the programmable electronic unit is programmed to compare said succession of diameters measured by the optical means with a corresponding succession of preset diameters and to calculate a sequence of differences between said measured and preset diameters;

said programmable electronic unit receives from said optical means a signal relating to the value of the actual diameter of the completed log such that the diameter assumed by each log when the winding of the latter is completed;

said programmable electronic unit determines a parameter related to the trend over time of the values forming said sequence of differences;

said programmable electronic unit changes the relative speed of said first and second roll depending on the value of said parameter;

said processing unit is connected to means for adjusting the thickness of the paper web reaching the winding station so as to effect an automatic adjustment of said thickness acting on said adjustment means if the parameter is between predetermined values and, where and are the ends of a range of values containing the zero value; and said automatic adjustment is performed on the basis of the diameter of the completed log as detected by said optical means by decreasing or increasing the thickness of the paper web on the basis of detected diameter of the completed log when the detected diameter of the completed log is, respectively, higher or lower than a preset diameter value.

2. The rewinder according to claim 1, wherein said ends of the range are equal, respectively, aN to the value −0.1 and aP to the value +0.1.

3. The rewinder according to claim 1, wherein said means for adjusting the thickness of the paper web comprise a tensioning device acting on said paper web upsteam of the rewinder and connected to said programmable electronic unit and controlled by the same.

4. The rewinder according to claim 3, wherein said processing unit acts initially on said tensioning device to act successively on said embossing device if the detected diameter of the completed log is still substantially different from the preset diameter.

5. The rewinder according to claim 3, wherein said processing unit acts initially on said tensioning device and successively acts on said calendering device if the detected diameter of the completed log is still substantially different from the preset diameter of the completed log.

6. The rewinder according to claim 1, wherein said means for adjusting the thickness of the paper web comprise an embossing device acting on said paper web upstream of the rewinder, provided with an actuator connected to said programmable electronic unit and controlled by the same.

7. The rewinder according to claim 1, wherein said means for adjusting the thickness of the paper web comprise a calendering device acting on said paper web upstream of the rewinder, provided with an actuator connected to said programmable electronic unit and controlled by the same.

8. The rewinder according to claim 1, wherein each diameter of the succession of diameters detected by the optical means is determined by the detection system upon detection of three points of a succession of images of the edge of one end of the log detected by said optical means in said sequence of detection times.

9. The rewinder according to claim 1, wherein said detected diameter of the completed log is determined by the optical means upon detection of at least four points of an image of the edge of one end of the log detected by the optical means with the subsequent determination of the diameter of all the circumferences passing through each set of said at least four points.

10. The rewinder according to claim 1, wherein the programmable electronic unit is provided with display means by which one or more of the following are displayed: the values of the actual measured diameters, the values of errors with respect to theoretical reference values, the trend of errors over time, any variations determined in the speed of the lower roll of the winding station compared to speed of the upper one.

* * * * *